United States Patent [19]

Hosford

[11] Patent Number: 4,825,650

[45] Date of Patent: May 2, 1989

[54] HOT GAS GENERATOR SYSTEM

[75] Inventor: Gregory S. Hosford, Rockford, Ill.

[73] Assignee: Sundstrand Corporation, Rockford, Ill.

[21] Appl. No.: 30,724

[22] Filed: Mar. 26, 1987

[51] Int. Cl.[4] ..... F02K 9/42

[52] U.S. Cl. ..... 60/267; 60/39.465; 60/39.511

[58] Field of Search ..... 60/39.461, 39.465, 39.511, 60/736, 266, 267; 62/52, 53

[56] References Cited

U.S. PATENT DOCUMENTS

| | | | |
|---|---|---|---|
| 2,956,402 | 10/1960 | Rae | 60/39.465 |
| 3,040,519 | 6/1962 | Rae | 60/39.461 |
| 3,101,592 | 8/1963 | Robertson et al. . | |
| 3,228,189 | 1/1966 | Baker . | |
| 3,237,401 | 3/1966 | Peters et al. | 60/267 |
| 3,328,957 | 7/1967 | Rose | 60/39.461 |
| 3,438,216 | 4/1969 | Smith | 62/52 |
| 3,992,891 | 11/1976 | Pecraja . | |
| 4,203,300 | 5/1980 | Hanson et al. | 62/52 |
| 4,345,729 | 8/1982 | Barten | 60/39.465 |

*Primary Examiner*—Louis J. Casaregola
*Attorney, Agent, or Firm*—Wood, Dalton, Phillips, Mason & Rowe

[57] ABSTRACT

A hot gas generator system which includes a combustor and a condenser, with the combustor connected to the condenser for condensing the product of combustion from the combustor. A hydrogen supply is connected to the condenser and then to the combustor whereby the hydrogen absorbs heat from the combustion product as it condenses and the hydrogen thereby is preheated prior to entering the combustor. An oxygen supply is connected to the combustor for mixing with the hydrogen during combustion. The combustor is part of an integrated heat exchanger/combustor whereby a minor portion of the hydrogen passing through the condenser is used in the combustor for burning purposes and a major portion of the hydrogen is passed through the combustor for superheating the hydrogen prior to delivering the hydrogen to a prime mover, such as a thruster or a turbogenerator of a space platform or the like.

5 Claims, 5 Drawing Sheets

HOT GAS GENERATOR SYSTEM

FIELD OF THE INVENTION

This invention generally relates to a hot gas generator system and, particularly, to a hydrogen-oxygen hot gas generator system for delivering heated hydrogen to a thruster, turbine or the like, with no products of combustion in the exhaust thereof.

BACKGROUND OF THE INVENTION

It is important for future space mission requirements, such as with space platforms, that a clean environment be maintained near the space platform or vehicle. Reaction control system thrusters, turbines or the like can be major contributors to contaminants in the immediate environment. Bi-propellant thrusters can be particularly objectionable because they exhaust products of combustion into the surrounding environment.

In particular, some of the problems created are that contaminants comprise noise sources for passive and active sensors. Particulates and condensibles can become deposited on surfaces, thereby degrading, impairing and in some instances destroying components vital to the space mission. Some vapors actually will attack and degrade various materials. Laser-optical mirrors are particularly sensitive to contaminants. Soot from hydrocarbon-based fuels, such as monomethyl hydrazine, can become deposited on the mirrors, and water vapor can degrade the mirror coatings. Changes in mirror absorptivity due to these contaminants can cause hot spots on the mirror and, at the very least, cause a degraded performance from thermal distortion or, in the worst instances, completely destroying the mirror.

The use of cold gas jets are desirable from a contamination viewpoint since the propellant is a non-condensible, non-reactive gas. However, cold gas jets have a low specific impulse which imposes a weight penalty. Although bi-propellant and hydrazine thrusters have specific impulses, their reaction products (Soot, CO, $CO_2$, $H_2O$, NH3, etc.) are objectionable. Even $H_2O_2$ thrusters developed for space mission use will spew water vapor into the environment.

There is a need for integrating the high specific impulse of a bi-propellant thruster with the environmental acceptability of a cold gas thruster. The present invention is directed to satisfying this need and solving the problems itemized above.

SUMMARY OF THE INVENTION

Accordingly, an object of the invention is to provide a gas generator system for such motive means as reaction control system thrusters, turbines or the like having high specific impulse and environmental acceptability.

Generally, the invention contemplates a hot gas generator system which includes a combustor, a condenser, a hydrogen supply and an oxygen supply. The combustor is connected to the condenser for condensing the product of combustion from the combustor. The hydrogen supply is connected to the condenser and then to the combustor whereby the hydrogen absorbs heat from the combustion product as it condenses, and the hydrogen thereby is preheated prior to entering the combustor. The oxygen supply is connected to the combustor for mixing with the hydrogen during combustion.

More particularly, the hydrogen supply is connected to the combustor by a first portion for supplying some of the hydrogen to the combustor for burning with the oxygen and a second portion for passing the remainder of the hydrogen through the combustor for superheating the hydrogen. Preferably, the second portion is sized to pass a majority of the hydrogen through the combustor for superheating purposes. The superheated hydrogen then is directed to the thruster of the system. The oxygen supply may be connected to the condenser for passing the oxygen through the condenser prior to passing the oxygen to the combustor.

In one embodiment of the invention, the condensate from condensing the product of combustion in the condenser is stored within the system. In another embodiment of the invention, an electrolyzer is used for receiving the condensate from the condenser, separating hydrogen and oxygen from the condensate, and recycling the hydrogen and oxygen to the respective hydrogen and oxygen supplies. In this manner, no products of combustion are exhausted to the environment, leaving only the hot hydrogen fed to the thruster.

In still another embodiment of the invention, means are provided for receiving liquid condensate from the condenser, and a secondary condenser is used for receiving uncondensed vapor from the primary condenser. The oxygen supply first is passed through the secondary condenser before being passed to the combustor. The secondary condenser can provide either an oxidizer-rich combustion system or a hydrogen/fuel-rich combustion system.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
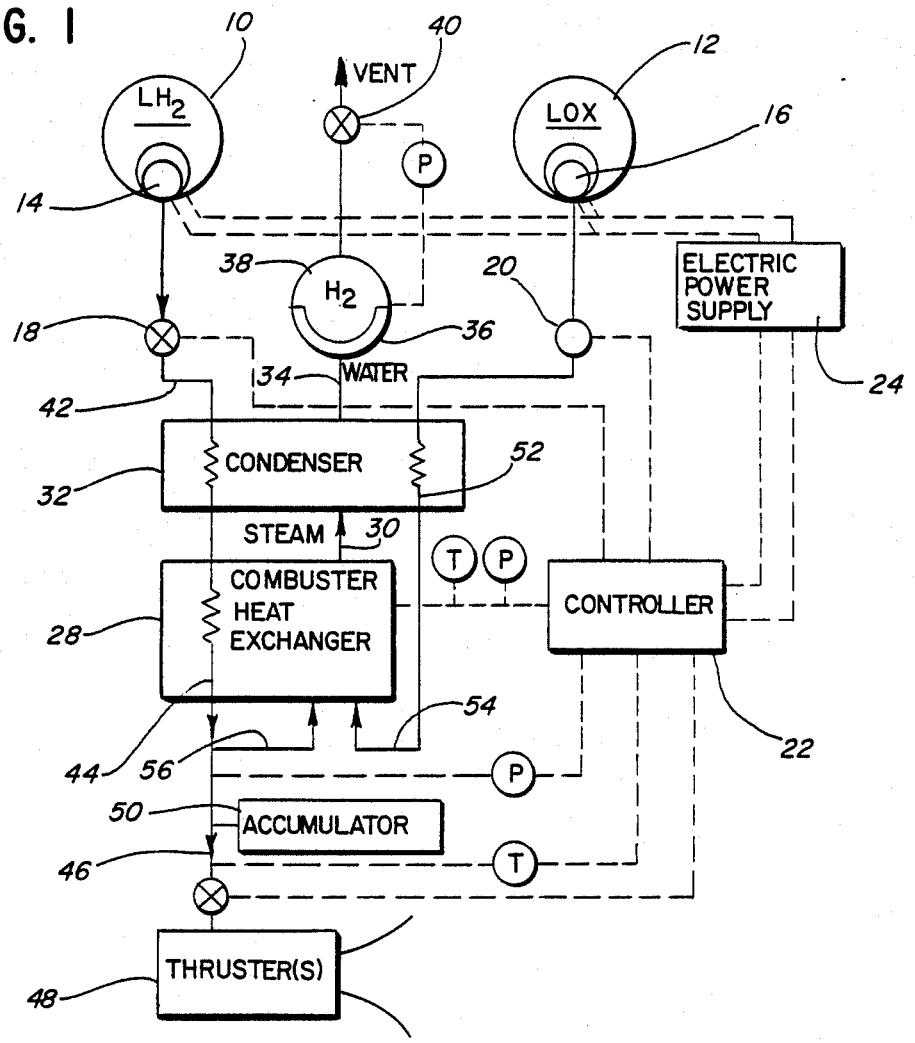
FIG. 1 is a schematic diagram of one embodiment of the invention in which liquid hydrogen and liquid oxygen are used.

Referring to the drawings in greater detail, and first to FIG. 1, a basic diagram of a hot gas generator system according to the invention is shown wherein hydrogen and oxygen are stored as liquids to minimize tankage weight and volume. Specifically, a liquid hydrogen supply 10 and a liquid oxygen supply 12 are provided.

The hydrogen and oxygen are pumped into the system by small motor pumps 14 and 16, respectively, through valves 18 and 20, respectively Although a variety of control means and electrical means may be devised for the system, the various pumps and valves of the system are generally illustrated as being under the control of a controller 22 and an electric power supply 24.

The system includes a combustor 28 wherein a stoichiometric mixture of hydrogen and oxygen is burned. The product of combustion, in the form of steam 30, then passes through a condenser 32 whereupon the combustion product is condensed to a liquid, such as water 34, the water then being passed to a liquid accumulator 36 where it is stored on the system, such as a space platform. Gaseous hydrogen 38 is used in the accumulator to prevent the water in the accumulator from "flashing" to steam. As the accumulator fills, a pressure relief valve 40 vents the noncontaminating hydrogen to space.

The system of this invention, as illustrated in FIG. 1, contemplates connecting liquid hydrogen supply 10, as through line 42, to condenser 32 whereby the hydrogen first enters the condenser where it is preheated by absorbing the sensible heat from the gases from combustor 28 as well as the latent heat of vaporization from the water combustion product. After leaving condenser 32, the hydrogen flows through a heat exchanger portion (described hereinafter) of combustor 28, as at 44, where the hydrogen absorbs the heat of the hydrogen-oxygen combustion. The superheated hydrogen from the heat exchanger portion of the combustor then is directed, as at 46, to a reaction control system thruster or thrusters 48 where the superheated hydrogen expands through the thruster nozzle providing the desired thrust. An accumulator 50 is used for tailoring the profile of the thrust pulse. Only noncontaminating hydrogen is exhausted to space.

Liquid oxygen from supply 12 passes through condenser 32, as at 52, and then to the integrated combustor/heat exchanger 28, as at 54.

Figure 2:
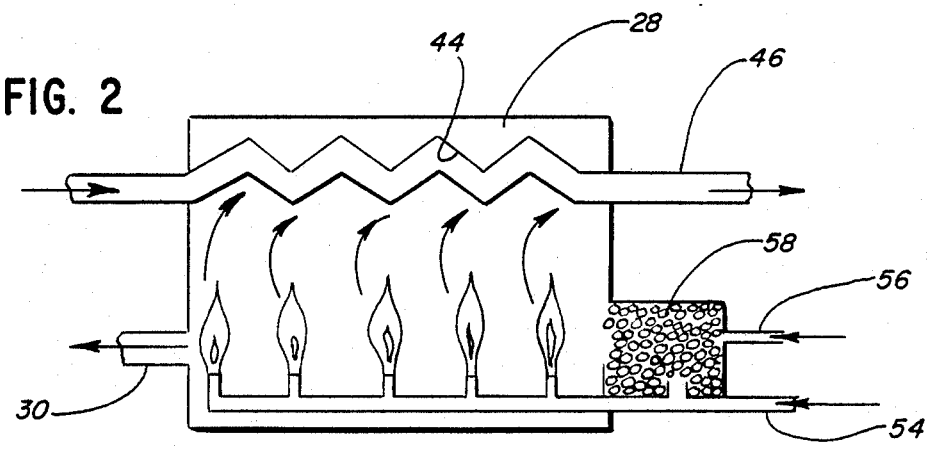
FIG. 2 is a somewhat schematic illustration of the integrated heat exchanger/combustor of the system.

FIG. 2 shows in detail the integrated heat exchanger/combustor 28 where it can be seen that hydrogen passes through the combustor, as at 44 described above in relation to FIG. 1. It should be noted that the hydrogen at this stage is in a gaseous state since the liquid hydrogen from supply 10 has been converted to a gas when passing through condenser 32. The supply of oxygen 54 and the water vapor product of combustion 30, described above, also are shown in FIG. 2. A small portion of hydrogen enters the integrated heat exchanger/combustor, at 56, and this also is shown in FIG. 1. The integrated heat exchanger/combustor employs staged combustion techniques, in a catalytic combustor 58. Specifically, the hydrogen-water vapor mixture in the combustor continuously rejects heat to the dry hydrogen in the heat exchanger portion of the device, i.e. the dry hydrogen passing through the device at 44. As heat is rejected to the dry hydrogen, oxygen is injected into the combustor providing heat energy to maintain the hydrogen-water vapor mixture in the combustor at operating temperature. All of the hydrogen fuel and oxygen are consumed in the combustor and only pure water vapor exits the combustor to the condenser, as at 30. In the condenser, the steam rejects its remaining sensible heat and latent heat of vaporization to the low temperature hydrogen from supply 10. As stated above, the liquid then enters accumulator 36 (FIG. 1) where it is stored on the platform.

Figure 3:
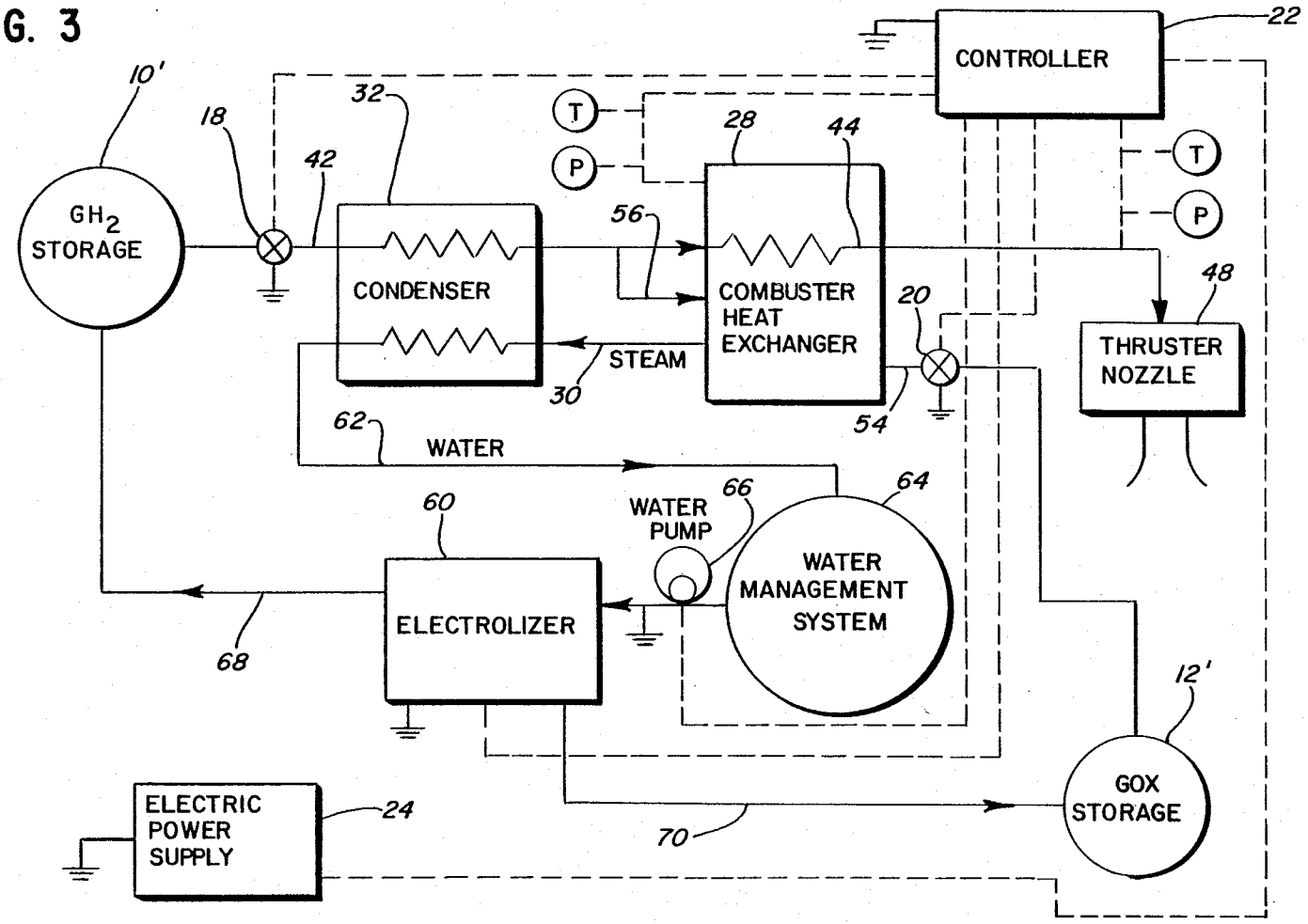
FIG. 3 is a schematic diagram of another embodiment of the system of this invention, employing gaseous hydrogen and gaseous oxygen.

FIG. 3 shows the system of this invention wherein gaseous hydrogen from a supply 10' and gaseous oxygen from a supply 12' are used in conjunction with an electrolyzer 60 whereby there will be no net oxygen consumption. In other words, the system of FIG. 2 shows thruster 48 adapted to a water electrolyzer reactant supply system concept, and wherein the hydrogen and oxygen are stored as high pressure gases and are used as the fuel, propellant and oxidizer as described in relation to the system of FIG. 1. Like numerals, therefore, have been applied to the system of FIG. 3 corresponding to like components described in relation to the system of FIG. 1, where applicable.

More particularly, FIG. 3 shows the system wherein condensed water, as at 62, from condenser 32 enters a water management system 64, where it can be recycled. A pump 66 directs water from the water management system to electrolyzer 60 where the hydrogen and oxygen are separated and recycled, as at 68 and 70, respectively, to gaseous hydrogen supply 10' and gaseous oxygen supply 12'.

Figure 4:
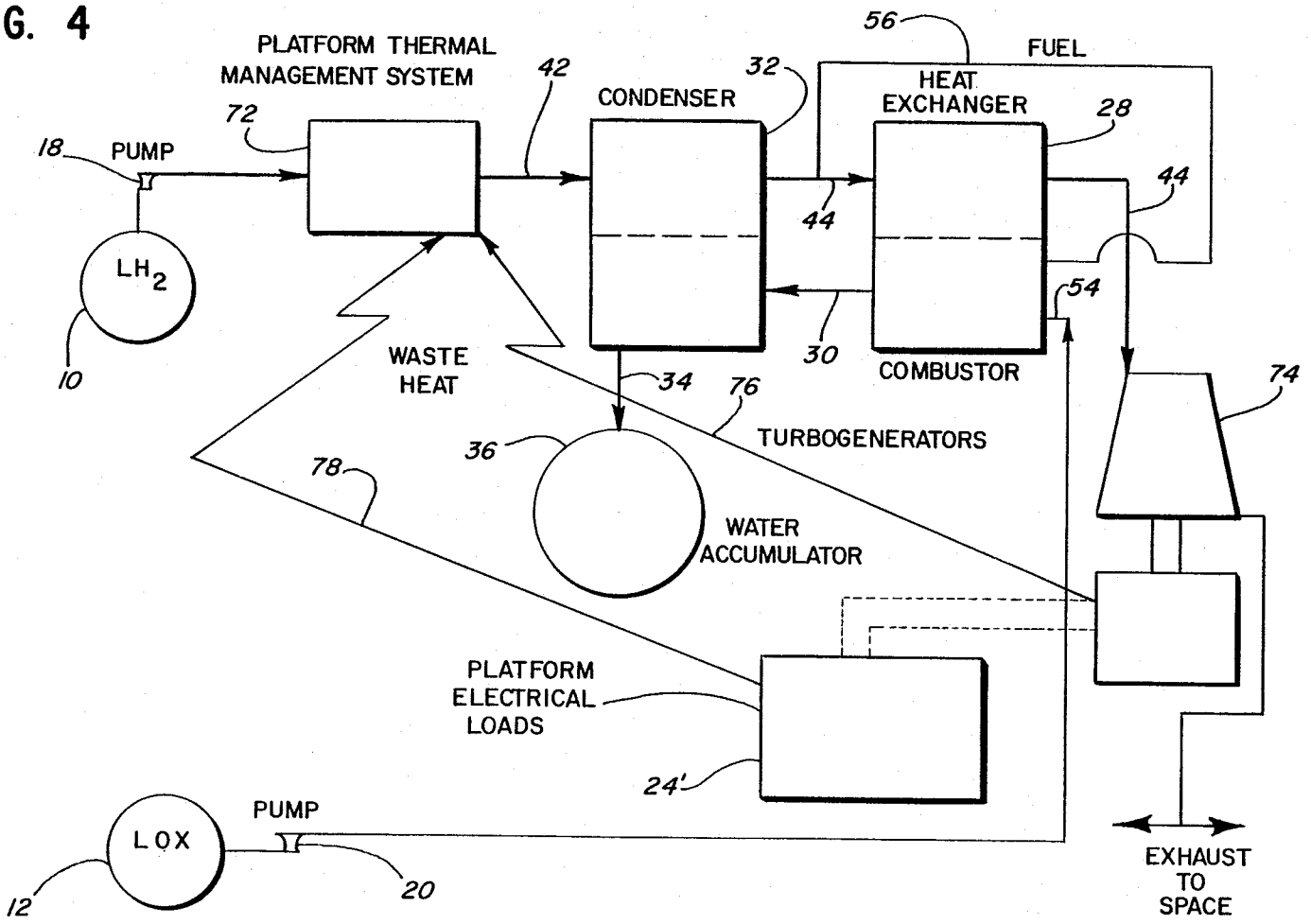
FIG. 4 is a schematic diagram of a system of the invention wherein liquid hydrogen is stored for platform thermal management.

FIG. 4 shows the power generation concept of the invention as illustrated in FIG. 1, i.e. with no products of combustion in the effluent. Like numerals have been applied to like components where applicable. However, FIG. 4 shows a diagram wherein the hydrogen fuel is stored as a sub-critical liquid and used for a platform thermal management system 72 of the spacecraft. Waste heat from turbogenerators 74 as well as from the platform electrical loads 24' also can be directed back to the platform thermal management system, as at 76 and 78, respectively. As with the system of FIG. 1, after leaving the platform thermal management system 72, the hydrogen enters condenser 32 where it absorbs the sensible heat of the gases from the combustor as well as the latent heat of vaporization from the water combustion product. After leaving the condenser, the small portion 56 of the hydrogen passes to the combustor as fuel, while the majority of the hydrogen flows, as at 44, through the heat exchanger portion of the integrated heat exchanger/combustor 28 where it absorbs the heat of the hydrogen-oxygen combustion. As described above, the superheated hydrogen from the heat exchanger then provides the energy to drive the thrusters or the turbogenerators which produce electrical power for the platform. The dry hydrogen leaving the turbines then exhausts to space through thrust-cancelling nozzles, as at 80.

Figure 5:
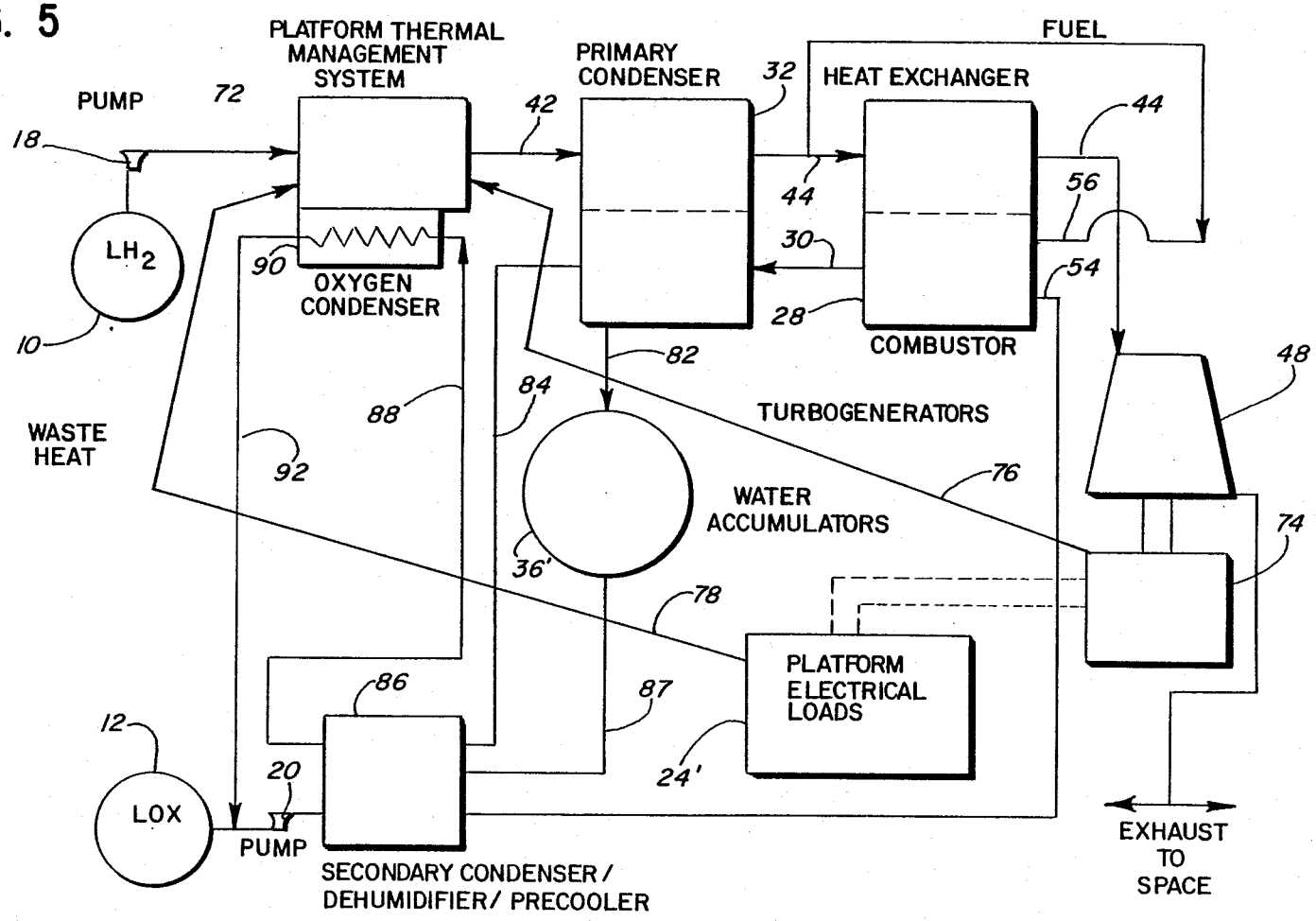
FIG. 5 is a schematic diagram of the system of the invention arranged for oxidizer-rich combustion.

FIG. 5 shows a diagram of the system of this invention, adapted for oxidizer-rich combustion. In comparing this system with FIG. 4, the thermal management system, the condenser and the heat exchanger/combustor concepts are essentially the same except that an oxygen-water vapor mixture leaves the combustor and enters a primary condenser 32'. Saturated liquid leaves this primary condenser through one path 82 where it is stored in a water accumulator 36'. A cooled oxygen-water vapor mixture leaves primary condenser 32' through another path 84 and enters a secondary water condenser/oxygen dehumidifier 86 and rejects its heat to oxygen from liquid oxygen supply 12. In other words, the liquid oxygen is conditioned prior to entering integrated heat exchanger/combustor 28. The water from the secondary water condenser/oxygen dehumidifier leaves the secondary water condenser humidifier through another path 87 and enters the water accumulator. The cooled dried oxygen from secondary condenser 86 then enters, as at 88, an oxygen condenser 90 and rejects its remaining sensible heat and latent heat of vaporization to the low temperature hydrogen from supply 10 through the platform thermal management system 72. The liquified oxygen, as at 92, then is injected into the inlet of oxygen pump 20 and recirculated to combustor 28.

Figure 6:
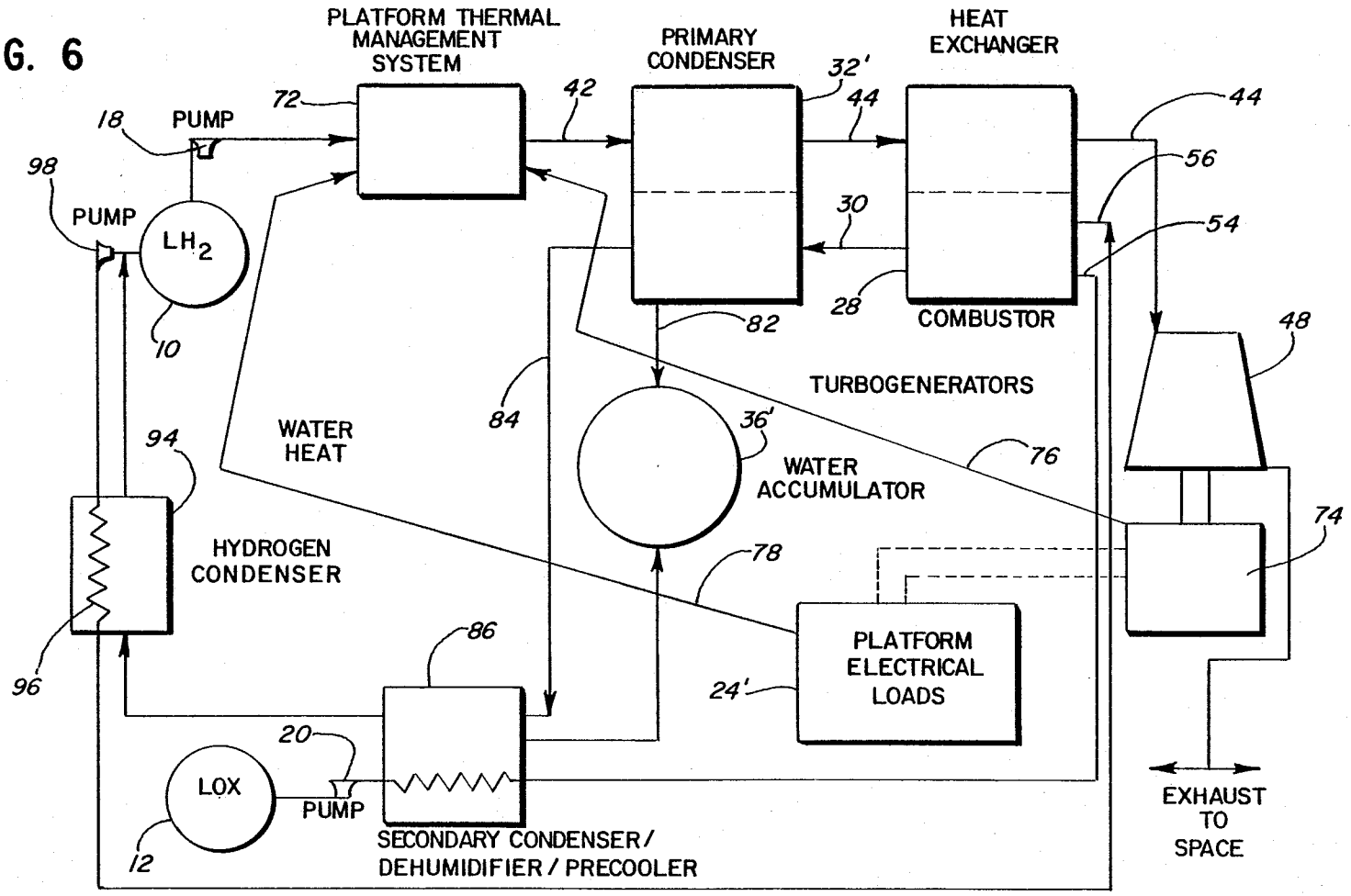
FIG. 6 is a schematic diagram of the system of the invention arranged for fuel-rich combustion.

FIG. 6 shows a diagram of the system of the invention adapted for fuel-rich combustion. The turbine working fluid and fuel flow paths must be kept separate in order to prevent the water vapor from entering the turbine working fluid. As in the oxidizer-rich combustion application described in relation to FIG. 5, primary condenser 32' and secondary condenser/dehumidifier/-precooler 86 remove the water from the hydrogen water vapor mixture leaving the combustor. The water is stored in water accumulator 36' and conditions the oxygen. The dry hydrogen then enters a hydrogen condenser 94 where it rejects its remaining sensible heat as it conditions the hydrogen fuel passing through the condenser, as at 96. Since this hydrogen is above its critical pressure of 12 atmospheres, it has no latent heat and "condenses" at a temperature on the order of 36° K., approximately 10° K. higher than the temperature of the hydrogen at the outlet of fuel pump 98. The condensed hydrogen then is injected into an inlet of a hydrogen fuel pump 98 and recirculated to combustor 28. The hydrogen fuel line is kept separate from the turbine working fuel line since there still will be some water in the hydrogen even after it leaves the secondary condenser/dehumidifier/precooler.

Although the power and thermal management systems of the fuel rich concept, as described in relation to FIG. 6, are not as well integrated as those of the stoichiometric concepts of FIGS. 1 and 3 and the oxidizer rich concept of FIG. 5, it has some distinct advantages. The heat exchanger and condenser will not be exposed to hot oxygen which could precipitate failure of the components. The hydrogen condenser will be simpler than the other condensers since the hydrogen will be above its critical pressure and there will be no regions of two phase flow. This arrangement also will allow higher combustor and condenser pressures than the other two concepts since the fuel pressure is independent of the coolant/working fluid pressure.

From the foregoing, it can be seen that the system of this invention employs hydrogen and oxygen which are the lightest fuel and oxidizer combination for open cycle chemical prime power sources. The system uses only the heat capacity of its own fuel in order to capture and condense its products of combustion. By integrating the power, thermal and effluent management systems employing thermophysical properties such as thermal availability, such as saturation temperature and pressure characteristics and staged combustion heat release, one of the major disadvantages of an open cycle chemical prime power source has been eliminated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A hot gas generator system, comprising:

combustor means;

condenser means;

means connecting the combustor means to the condenser means for condensing the product of combustion from the combustor means;

hydrogen supply means;

means connecting the hydrogen supply means to the condenser means whereby the hydrogen absorbs heat from the combustion product as it condenses and the hydrogen thereby is preheated;

means connecting the hydrogen preheated in the condenser means to a heat exchanger portion of the combustor means whereby the hydrogen absorbs the heat of the combustion and the hydrogen thereby is superheated;

means supplying at least a portion of the superheated hydrogen to the combustor for combustion therein;

oxygen supply means; and means connecting the oxygen supply means to the combustor means for mixing with the hydrogen therein during combustion.

2. The hot gas generator system of claim 1, including thruster means for receiving superheated hydrogen from the combuster means.

3. The hot gas generator system of claim 1 wherein said means connecting the oxygen supply means to the combustor means include means for first passing the oxygen through the condenser means.

4. The hot gas generator system of claim 1, including means for storing condensate from the condenser means.

5. The hot gas generator system of claim 1 wherein said hydrogen supply means comprise a source of liquid hydrogen which is converted to a gaseous state when the hydrogen passes through the condenser means.

* * * * *